US010786842B2

(12) United States Patent
Zhou et al.

(10) Patent No.: US 10,786,842 B2
(45) Date of Patent: Sep. 29, 2020

(54) DRAW-IN CONTROL FOR SHEET DRAWING

(71) Applicants: Dajun Zhou, Troy, MI (US); Changqing Du, Troy, MI (US); Robert D Miller, Lake Orion, MI (US)

(72) Inventors: Dajun Zhou, Troy, MI (US); Changqing Du, Troy, MI (US); Robert D Miller, Lake Orion, MI (US)

(73) Assignee: FCA US LLC, Auburn Hills, MI (US)

( * ) Notice: Subject to any disclaimer, the term of this patent is extended or adjusted under 35 U.S.C. 154(b) by 212 days.

(21) Appl. No.: 16/128,587

(22) Filed: Sep. 12, 2018

(65) Prior Publication Data

US 2020/0078846 A1 Mar. 12, 2020

(51) Int. Cl.
*B21D 24/16* (2006.01)
*B21D 24/00* (2006.01)
(Continued)

(52) U.S. Cl.
CPC ..... *B21D 24/005* (2013.01); *B21D 22/22* (2013.01); *B21D 24/16* (2013.01); *B21D 22/02* (2013.01); *B21D 24/02* (2013.01); *B21D 24/04* (2013.01)

(58) Field of Classification Search
CPC ..... B21D 22/00; B21D 22/02; B21D 22/20; B21D 22/21; B21D 22/22; B21D 22/30;
(Continued)

(56) References Cited

U.S. PATENT DOCUMENTS 1,415,838 A * 5/1922 Griffiths ..... B21D 24/16 72/361
1,651,505 A * 12/1927 Berg ..... B21D 22/02 72/398
(Continued)

FOREIGN PATENT DOCUMENTS

DE 19717299 C2 3/2002
DE 202005013912 U1 12/2005
(Continued)

OTHER PUBLICATIONS

Spindler, J., et al., "The Audi Toolshop" Plenary Papers: Efficiency in Forming Technology, conference, Nov. 10-11, 2015, p. 15-31.
(Continued)

*Primary Examiner* — Edward T Tolan
(74) *Attorney, Agent, or Firm* — Ralph E Smith

(57) ABSTRACT

A method of forming a finished stamped product includes positioning a blank on a blank holder between an upper die and a lower die, inserting a movable wedge block between the blank holder and the upper die to establish a first binder gap, and while the movable wedge block is inserted, performing a first strike of the blank by lowering the upper die a first distance to contact and partially form the blank, the movable wedge block limiting downward movement of the upper die relative to the lower die. After the first strike, withdrawing the movable wedge block to establish a second binder gap between the blank holder and the upper die, and while the movable wedge block is withdrawn, performing a
(Continued)

second strike of the blank by lowering the upper die a second distance to finally form the blank into the finished product.

13 Claims, 2 Drawing Sheets

(51) Int. Cl.

| | |
|---|---|
| ***B21D 22/22*** | (2006.01) |
| *B21D 24/04* | (2006.01) |
| *B21D 24/02* | (2006.01) |
| *B21D 22/02* | (2006.01) |

(58) Field of Classification Search
CPC ..... B21D 24/00; B21D 24/005; B21D 24/04; B21D 24/10; B21D 24/12; B21D 24/16; B21D 43/26; B30B 15/285; B30B 15/287
See application file for complete search history.

(56) References Cited

U.S. PATENT DOCUMENTS

| | | | | |
|---|---|---|---|---|
| 3,299,689 | A | 1/1967 | Dolney et al. | |
| 3,993,898 | A * | 11/1976 | Guliani | B30B 15/285 250/215 |
| 3,999,477 | A * | 12/1976 | Good | B30B 15/28 100/350 |
| 4,358,263 | A * | 11/1982 | Shiraishi | B21D 22/02 425/397 |
| 5,138,857 | A | 8/1992 | Siegert | |
| 6,006,576 | A | 12/1999 | Genseberger et al. | |
| 6,068,245 | A | 5/2000 | Roper | |
| 7,130,708 | B2 | 10/2006 | Wang et al. | |
| 7,536,892 | B2 | 5/2009 | Amino et al. | |
| 8,857,237 | B2 * | 10/2014 | Chien | B21D 22/02 72/347 |
| 10,065,228 | B2 * | 9/2018 | Huang | B21D 22/02 |
| 2014/0186481 | A1 * | 7/2014 | Lee | B29C 51/04 425/395 |
| 2019/0009322 | A1 * | 1/2019 | Schleich | B21D 24/04 |

FOREIGN PATENT DOCUMENTS

| | | | | |
|---|---|---|---|---|
| EP | 0806256 | | 11/1997 | |
| EP | 3012038 | A1 * | 4/2016 | B21D 22/22 |
| FR | 2975611 | A1 * | 11/2012 | B21D 24/10 |
| FR | 3029437 | A1 * | 6/2016 | B21D 24/00 |
| FR | 3059258 | B1 * | 11/2018 | B21D 24/04 |

OTHER PUBLICATIONS

Yamashita et al. "Technology to Enhance Deep-Drawability by Strain Dispersion Using Stress Relaxation Phenomenon," SAE Technical Paper 2015-01-0531, 2015.

Osakada, K & Mori, Keisuke & Altan, T & Groche, P. (2011). Mechanical servo press technology for metal forming. CIRP Annals—Manufacturing Technology, vol. 60. 651-672.10.1016/j.cirp. 2011. 05.007.

* cited by examiner

DRAW-IN CONTROL FOR SHEET DRAWING

FIELD

The present application relates generally to stamping presses and, more particularly, to a double-hit servo press with a movable spacer wedge block for draw-in control.

BACKGROUND

Conventional sheet metal forming includes presses with drawing devices having an upper tool or die and a lower tool or die. The upper tool is typically installed on a lower surface of a vertically movable press ram, and the lower tool typically includes a stationary bottom drawing punch disposed on a press bed. A metal sheet or blank is fed between the upper and lower tools and the upper tool is brought down onto the lower tool to form a stamped metal sheet. In order to control deformities, the sheet metal is often held in multiple locations during the drawing operation to control the amount of sheet metal drawn into the forming die (i.e., draw-in). However, during the forming process, drawing too much sheet metal into the forming cavity can result in wrinkles or surface distortions of the stamped metal sheet, and drawing too little sheet metal into the forming die cavity can result in tears or cracks in the stamped metal sheet. Moreover, after pressing, some drawn panels spring back to a different shape than intended, commonly referred to as springback. Thus, while many conventional presses work well for their intended purpose, there remains a need for continuous improvement in the relevant art.

SUMMARY

In accordance with one example aspect of the disclosure, a method of forming a finished stamped product from a blank in a servo stamping press having an upper die, a lower die, and a blank holder is provided. In one example implementation, the method includes positioning the blank on the blank holder between the upper die and lower die, and inserting a movable wedge block between the blank holder and the upper die to establish a first binder gap. While the movable wedge block is inserted, a first strike of the blank is performed by lowering the upper die a first distance to contact and partially form the blank, wherein the movable wedge block limits movement of the upper die to less than a full movement. After the first strike, the movable wedge block is withdrawn to establish a second binder gap between the blank holder and the upper die that is smaller than the first binder gap. While the movable wedge block is withdrawn, a second strike of the blank is performed by lowering the upper die a second distance greater than the first distance to contact and finally form the blank into the finished stamped product.

In addition to the foregoing, the described method may include one or more of the following: during the second strike, gripping the partially formed blank with a surface texture on at least one of the upper die and the blank holder; forming the surface texture as teeth configured to at least partially penetrate the blank; forming the surface texture as a bead configured to be received in a corresponding trough; and drawing the upper die upwardly between the first strike and the second strike.

In addition to the foregoing, the described method may include one or more of the following: drawing the upper die upward after the second strike and simultaneously re-inserting the movable wedge block between the blank holder and the upper die to re-establish the first binder gap; and wherein a cushion supports the blank holder with a variable cushion force, and further comprising performing a two-stage cushion force operation including in a first stage, providing the cushion with a relatively lower cushion force to create a low draw-in resistance force and allow the blank to have increased draw-in, and in a subsequent second stage, providing the cushion with a relatively higher cushion force to create a post-stretch condition to reduce springback of the blank.

In accordance with another example aspect of the disclosure, a servo stamping press for forming a finished stamped product from a blank is provided. In one example implementation, the servo stamping press includes an upper die for at least partially forming the finished stamped product, a lower die having a stationary punch, and a blank holder configured to provide a support surface for the blank. A movable wedge block is configured to be moved between an inserted position and a withdrawn position, wherein in the inserted position the movable wedge block establishes a first binder gap between the upper die and the lower die configured to limit downward movement of the upper die to less than a full movement. In the withdrawn position, the movable wedge block establishes a second binder gap between the upper die and the lower die. A controller is programmed to move the movable wedge block to the inserted position, while the movable wedge block is in the inserted position, perform a first strike of the blank by lowering the upper die a first distance to contact and partially form the blank, after the first strike, move the movable wedge block to the withdrawn position, and while the movable wedge block is in the withdrawn position, command a second strike of the blank by lowering the upper die a second distance greater than the first distance to contact and finally form the blank into the finished stamped product.

In addition to the foregoing, the described servo stamping press may include one or more of the following: a surface texture on at least one of the upper die and the blank holder to facilitate gripping the partially formed blank during the second strike, wherein the surface texture is formed as teeth configured to penetrate the blank, wherein the controller is further programmed to command drawing the upper die upwardly between the first strike and the second strike; and wherein the controller is further programmed to command drawing the upper die upward after the second strike and simultaneously re-insert the movable wedge block into the inserted position.

In addition to the foregoing, the described servo stamping press may include one or more of the following: a cushion configured to support the blank holder with a variable cushion force, and wherein the controller is further programmed to command performing a two-stage cushion force operation including in a first stage, provide the cushion with a relatively lower cushion force to create a low draw-in resistance force and allow the blank to have increased draw-in, and in a subsequent second stage, provide the cushion with a relatively higher cushion force to create a post-stretch condition to reduce springback.

Further areas of applicability of the teachings of the present application will become apparent from the detailed description, claims and the drawings. It should be understood that the detailed description, including disclosed embodiments and drawings referenced therein, are merely exemplary in nature intended for purposes of illustration only and are not intended to limit the scope of the present application, its application or uses. Thus, variations that do not depart from the gist of the present application are intended to be within the scope of the present application.

DESCRIPTION

The present application is generally directed to systems and methods for controlling draw-in of a sheet metal blank during a stamping process. In one example, a double-hit capacity servo stamping press operates a first hit with a first distance to achieve a partial formation of the blank, followed by a second hit to form a completed stamped metal sheet. During the first hit, a movable wedge block is disposed in the stamping press between the die and the blank holder to control the gap distance of binders during the first hit to thereby ease the draw-in. After the first hit, the movable wedge block is withdrawn a predetermined distance to allow wedge position adjustment and reduction of the gap distance such that during the second hit the blank is held between teeth on the dies to reduce draw-in or even lock the sheet's movement for springback reduction.

Figure 3:
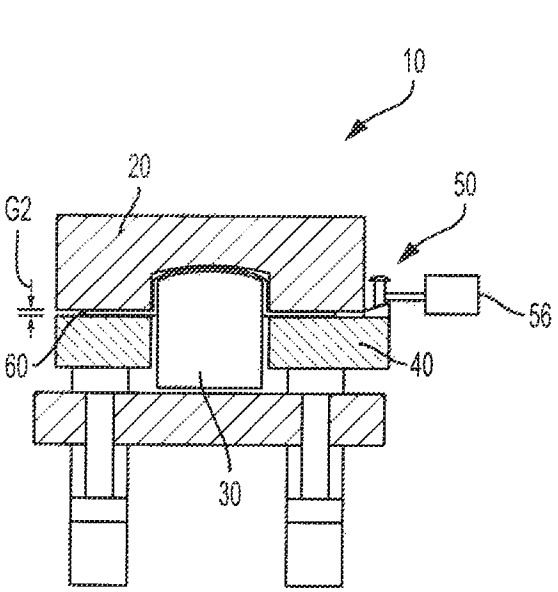
FIG. 3 is a schematic cross-sectional view of the servo stamping press of FIG. 1 in a third position, according to the principles of the present disclosure.
Figure 2:
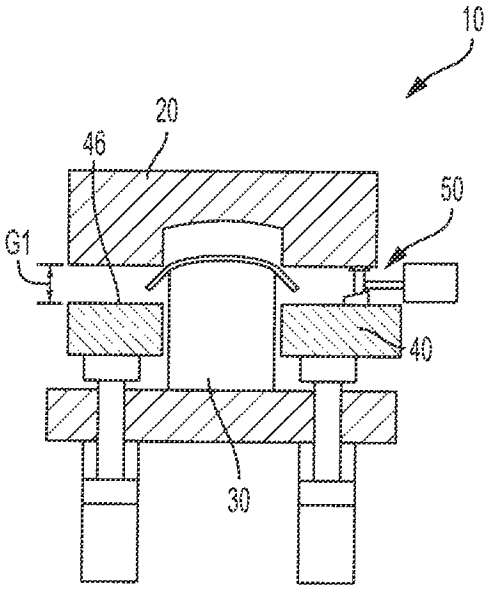
FIG. 2 is a schematic cross-sectional view of the servo stamping press of FIG. 1 in a second position, according to the principles of the present disclosure.
Figure 1:
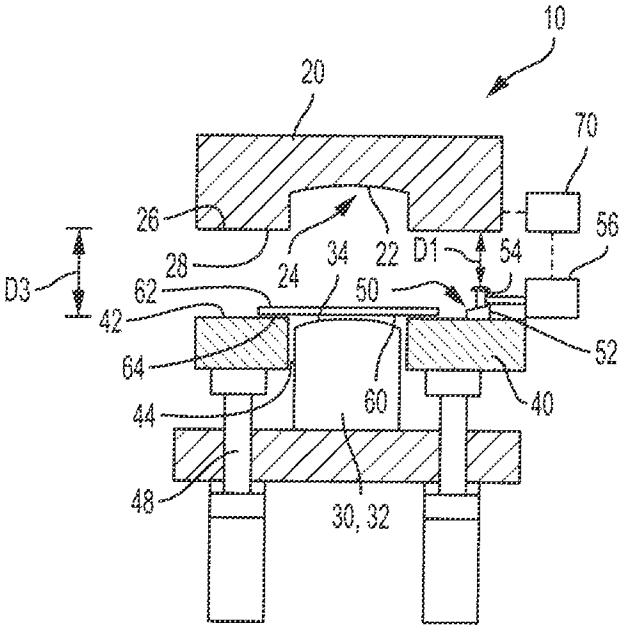
FIG. 1 is a schematic cross-sectional view of an example servo stamping press in a first position, according to the principles of the present disclosure.

Referring to FIGS. 1-3, an example servo stamping press is generally shown and indicated at reference numeral 10. In the example embodiment, servo stamping press 10 generally includes an upper tool or die 20, a lower tool or die 30, a binder ring or blank holder 40, and a spacer or movable wedge block 50. The upper die 20 includes a movable upper die or upper die 22, and the lower die 30 includes a stationary male die or punch 32. A workpiece or blank 60 (e.g., sheet metal) is disposed on the blank holder 40 between the upper die 20 and lower die 30 for subsequent stamping thereof.

In the example embodiment, the upper die 22 defines a cavity 24 configured to shape a top surface 62 of the blank 60. A periphery 26 of the upper die 22 at least partially surrounding the cavity 24 includes a surface texture 28 on portions thereof configured to contact, engage, or otherwise grip top surface 62 to facilitate holding the blank 60 during the stamping process, as described herein in more detail.

As shown in the illustrated example, lower die 30 includes stationary punch 32 having a punch surface 34 configured to shape a bottom surface 64 of the blank 60.

In the example embodiment, blank holder 40 includes a support surface 42 defining an opening 44 configured to receive the stationary punch 32 therethrough. The support surface 42 includes a surface texture 46 on portions thereof configured to contact, engage, or otherwise grip the bottom surface 64 of blank 60. Additionally, or alternatively, support surface 42 or upper die periphery 26 may include a bead (not shown) configured to be received in a trough formed in the other of the support surface 42 or upper die periphery 26.

In the example embodiment, movable wedge block 50 generally includes a wedge 52 with a block 54 extending upwardly therefrom. A fixed wedge or actuator 56 (e.g., a motor) is configured to selectively horizontally insert/remove the movable wedge block 50 from in between the upper die 20 and the blank holder 40. When in the inserted position, movable wedge block 50 is configured to establish a first predetermined binder gap 'G1' (FIG. 2) that facilitates limiting a distance the downwardly moving upper die 20 can travel relative to the lower die stationary punch 32 and blank holder 40. Such spacing by wedge block 50 enables a relatively low draw-in resistance force to allow the blank 60 to have more draw-in. For example, the spacing prevents the surface textures 28, 46 from clamping blank 60 (e.g., the teeth do not bite into blank 60). As illustrated, when inserted, wedge 52 is disposed on and configured to engage blank holder support surface 42, and block 54 is configured to engage upper die periphery 26.

In the example embodiment, servo stamping press 10 is digitally programmable and includes a programmable controller 70 for controlling movements and components of the servo stamping press 10. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

In one example operation, controller 70 commands the servo stamping press 10 to begin in the position shown in FIG. 1 with upper die 20 spaced apart from lower die 30 and blank holder 40. Movable wedge block 50 is disposed in between upper die 20 and blank holder 40 by actuator 56, and controller 70 commands blank 60 to be subsequently inserted into the servo stamping press 10 and disposed on the blank holder 40 between the upper die 20 and the lower die 30.

Figure 4:
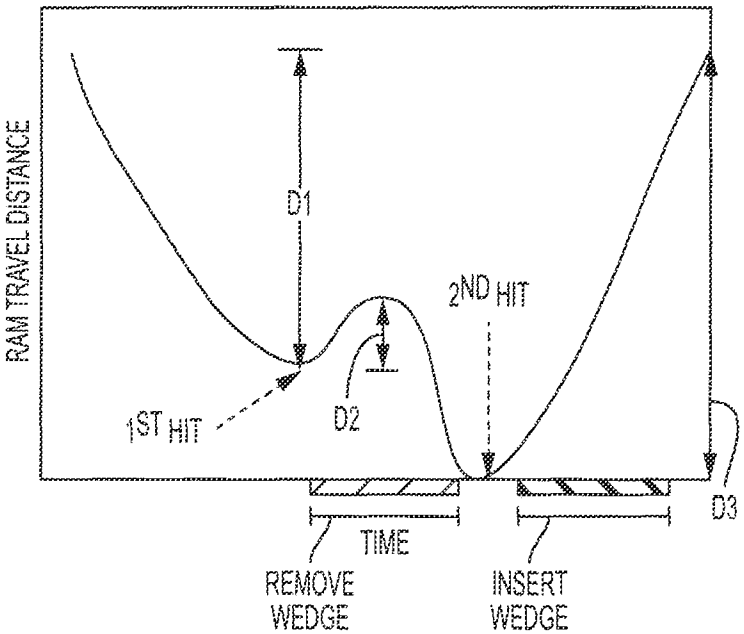
FIG. 4 is a graphical illustration of an example ram movement of the servo stamping press shown in FIG. 1, according to the principles of the present disclosure.

As shown in FIG. 4, the servo stamping press 10 is then commanded to operate in a double-hit capacity by first lowering the upper die 22 a first predetermined distance 'D1' less than a full forming movement to engage and partially form the blank 60 around the stationary punch 32 in a first "strike" or press (as shown in FIG. 2). The upper die 22 is prevented from further movement toward lower die 30 by the movable wedge block 50, which establishes the first binder gap 'G1' to prevent surface texture 28, 46 from engaging blank 60, thereby establishing the relatively low draw-in resistance force to allow the blank 60 to have more draw-in. After the first strike, controller 70 commands the upper die 22 to be vertically drawn back a predetermined distance 'D2' and movable wedge block 50 is horizontally withdrawn a predetermined distance by actuator 56 to establish a second predetermined binder gap 'G2' that enables the surface texture 28, 46 to engage and grip blank 60. For example, the upper die 22 is vertically drawn back distance 'D2' to release pressure on the wedge block 50 in order to relocate the wedge block 50.

In the example operation, controller 70 commands the upper die 22 to then be lowered to a third predetermined distance 'D3' beyond distance 'D1' to engage and finally form the blank 60 around the stationary punch 32 in a second strike or press (as shown in FIG. 3). During such movement, a portion the blank 60 (e.g., the outer periphery) is held between the upper die periphery 26 and blank holder 40 and at least partially gripped by surface texture 28 and/or surface texture 46. In one example, surface textures 28, 46 are teeth configured to penetrate into the sheet metal surface and facilitate preventing sheet-tool sliding. The controller 70 then commands upper die 22 to be drawn back to the starting position, and movable wedge block 50 is again inserted by actuator 56 between the upper die 20 and the blank holder 40 for repeating of the forming process. Controller 70 then commands the pressed blank 60 to be removed from the servo stamping press 10 as a finished stamped product.

In one example, 'D1' is between approximately 80% and approximately 100% of 'D3' or between 80% and 100% of 'D3'. In another example, 'D1' is approximately 90% of 'D3' or 90% of 'D3'.

Figure 5:
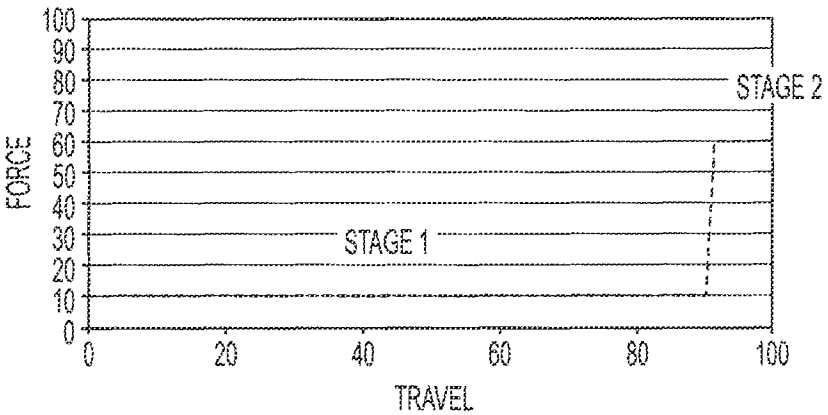
FIG. 5 is a graphical illustration of an example cushion force of the servo stamping press shown in FIG. 1, according to the principles of the present disclosure.

As shown in FIG. 5, the stamping process described herein enables a two-stage cushion force to be programmed for a double hit in one strike while incorporating movable wedge block 50 to create a variable draw-in controlling force. The cushion force is provided by one or more air pins 48 configured to support blank holder 40 with a variable resistance, thereby enabling the two-stage cushion force. As such, in the example embodiment, the servo stamping press 10 is operated in a first stage with a relatively lower cushion force (e.g., 10 tons). This lower cushion force is set before the end of the first strike to create a low draw-in resistance force and allow the blank 60 to have more draw-in.

In a second stage after the first strike, the servo stamping press 10 is operated with a relatively higher cushion force (e.g., 60 tons) to create a high draw-in resistance force or a near lock condition. This higher cushion force is configured to reduce draw-in or even lock movement of blank 60. Additionally, the higher cushion force is configured to create a post-stretch condition, which is a die process where the blank is locked-up (e.g., clamping the blank with stake bead, teeth, etc.) to stop draw-in and subsequently stretched over the punch prior to the press reaching the bottom of the strike. This is configured to induce a minimum of 2% stretch in the blank near the bottom of the press strike, which has proven effective in reducing residual stresses gradient and reducing or eliminating springback to thus form a finished stamped product with more accurate dimensions. Moreover, the resultant stretch in the sidewall of the blank is configured to reduce part-to-part variation caused by incoming material variation.

It will be appreciated that while shown with the example servo stamping press 10 illustrated in FIGS. 1-3, the systems and methods described herein may be utilized with various other stamping presses such as, for example, that described in commonly owned U.S. Pat. No. 9,914,164, the contents of which are incorporated herein in their entirety by reference thereto.

Described herein are systems and methods for controlling draw-in of a sheet metal blank during a stamping process. A double-hit capacity servo stamping press performs a first strike to partially form the blank. During the first strike, a movable spacer wedge is disposed in the stamping press between the die and the blank holder to control the binder gap distance of the ram during the first hit to thereby ease the draw-in. After the first hit, the movable space wedge is removed and a second strike causes the partially formed blank to be held between gripping surfaces on the dies to reduce draw-in or even lock the sheet's movement for springbuck reduction.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A method of forming a finished stamped product from a blank in a servo stamping press having an upper die, a lower die, and a blank holder, the method comprising:

positioning the blank on the blank holder between the upper die and lower die;

inserting a movable wedge block between the blank holder and the upper die to establish a first binder gap;

while the movable wedge block is inserted, performing a first strike of the blank by lowering the upper die a first distance to contact and partially form the blank, wherein the movable wedge block limits movement of the upper die to less than a full movement;

after the first strike, withdrawing the movable wedge block to establish a second binder gap between the blank holder and the upper die that is smaller than the first binder gap; and while the movable wedge block is withdrawn, performing a second strike of the blank by lowering the upper die a second distance greater than the first distance to contact and finally form the blank into the finished stamped product.

2. The method of claim 1, further comprising during the second strike, gripping the partially formed blank with a surface texture on at least one of the upper die and the blank holder.

3. The method of claim 2, further comprising forming the surface texture as teeth configured to at least partially penetrate the blank.

4. The method of claim 2, further comprising forming the surface texture as a bead configured to be received in a corresponding trough.

5. The method of claim 1, further comprising drawing the upper die upwardly between the first strike and the second strike.

6. The method of claim 1, further comprising drawing the upper die upward after the second strike and simultaneously re-inserting the movable wedge block between the blank holder and the upper die to re-establish the first binder gap.

7. The method of claim 1, wherein a cushion supports the blank holder with a variable cushion force, and further comprising performing a two-stage cushion force operation including:

in a first stage, providing the cushion with a relatively lower cushion force to create a low draw-in resistance force and allow the blank to have increased draw-in; and in a subsequent second stage, providing the cushion with a relatively higher cushion force to create a post-stretch condition to reduce springbuck of the blank.

8. A servo stamping press for forming a finished stamped product from a blank, the servo stamping press comprising:

an upper die for at least partially forming the finished stamped product;

a lower die having a stationary punch;

a blank holder configured to provide a support surface for the blank;

a movable wedge block configured to be moved between an inserted position and a withdrawn position, wherein in the inserted position the movable wedge block establishes a first binder gap between the upper die and the lower die configured to limit downward movement of the upper die to less than a full movement, and in the withdrawn position the movable wedge block provides for a second binder gap between the upper die and the lower die; and a controller programmed to:

move the movable wedge block to the inserted position;

while the movable wedge block is in the inserted position, perform a first strike of the blank by lowering the upper die a first distance to contact and partially form the blank;

after the first strike, move the movable wedge block to the withdrawn position; and while the movable wedge block is in the withdrawn position, command a second strike of the blank by lowering the upper die a second distance greater than the first distance to contact and finally form the blank into the finished stamped product.

9. The servo stamping press of claim 8, further comprising a surface texture on at least one of the upper die and the blank holder to facilitate gripping the partially formed blank during the second strike.

10. The servo stamping press of claim 9, wherein the surface texture is formed as teeth configured to penetrate the blank.

11. The servo stamping press of claim 8, wherein the controller is further programmed to command drawing the upper die upwardly between the first strike and the second strike.

12. The servo stamping press of claim 8, wherein the controller is further programmed to command drawing the upper die upward after the second strike and simultaneously re-insert the movable wedge block into the inserted position.

13. The servo stamping press of claim 8, further comprising a cushion configured to support the blank holder with a variable cushion force, and wherein the controller is further programmed to command performing a two-stage cushion force operation including:

in a first stage, provide the cushion with a relatively lower cushion force to create a low draw-in resistance force and allow the blank to have increased draw-in; and in a subsequent second stage, provide the cushion with a relatively higher cushion force to create a post-stretch condition to reduce springbuck.

* * * * *